US005774864A

United States Patent [19]

Han et al.

[11] Patent Number: 5,774,864

[45] Date of Patent: Jun. 30, 1998

[54] COMPOSITE DYNAMIC-CROSSTALK/ PHANTOM-CENTER DECODER FOR MPEG-2 MULTICHANNEL AUDIO

[75] Inventors: Young Tae Han; Sang Tae Choi; Jong Seog Koh; Soon Hong Kwon, all of Taejeon, Rep. of Korea

[73] Assignee: Korea Telecommunication Authority, Seoul, Rep. of Korea

[21] Appl. No.: 696,030

[22] Filed: Aug. 9, 1996

[30] Foreign Application Priority Data

Aug. 9, 1995 [KR] Rep. of Korea ..... 95-24569

[51] Int. Cl.[6] ..... H04S 3/00

[52] U.S. Cl. ..... 704/500; 704/229; 81/2

[58] Field of Search ..... 704/500, 229, 704/230; 381/2

[56] References Cited

U.S. PATENT DOCUMENTS

| | | | |
|---|---|---|---|
| 5,488,665 | 1/1996 | Johnston et al. | 381/2 |
| 5,583,962 | 12/1996 | Davis et al. | 704/229 |
| 5,632,005 | 5/1997 | Davis et al. | 704/304 |
| 5,633,981 | 5/1997 | Davis | 704/230 |

OTHER PUBLICATIONS

ISO/IEC International Standard 13813–3 "Information technology—Generic coding of moving pictures and associated audio information—Part 3: Audio", May 1995.

Young Tae Han, et al. "Design and Implementation of the MPEG–2 Multi–Channel Audio Decoder," IEICE Transactions on Information and Systems, vol. E79–D, No. 6, pp. 759–763, Jun. 1996.

Sung–Chul Han, et al. "An ASIC Implementation of the MPEG–2 Audio Decoder," IEEE Trans. on Consumer Electronics, vol. 42, No. 3, pp. 540–545, Aug. 1996.

Peter Noll, "MPEG Digital Audio Coding," IEEE Signal Processing Magazine, pp. 59–81, Sep. 1997.

Marina Bosi, Karlheinz Brandenburg, Schuyler Quackenbush, Louis Fielder, Kenzo Akagiri, Hendrik Fuchs, Martin Dietz, Juergen Herre, Grant Davidson, and Yoshiaki Oikawa, "ISO/MPEG–2 Advanced Audio Coding," Preprint 4382 for the 101st Convention of the Aud, Nov. 1996.

*Primary Examiner*—David R. Hudspeth
*Assistant Examiner*—Tālivaldis Ivars Šmits
*Attorney, Agent, or Firm*—Merchant, Gould, Smith, Edell, Welter & Schmidt

[57] ABSTRACT

A composite decoding device for an MPEG-2 multichannel audio decoder. The composite decoding device is capable of simultaneously decoding information coded in a dynamic crosstalk coding manner and information coded in a phantom coding manner. To this end, the composite decoding device comprises an arithmetic unit for receiving a control word, information and a scale factor from a first-in-first-out memory, performing an arithmetic operation with respect to the received information and scale factor on the basis of a dynamic crosstalk coding manner or a phantom coding manner determined by the received control word and outputting the arithmetic result to a dual port memory, and a controller for generating a plurality of sequential control signals in response to the control word from the first-in-first-out memory to control the arithmetic unit.

4 Claims, 1 Drawing Sheet

COMPOSITE DYNAMIC-CROSSTALK/ PHANTOM-CENTER DECODER FOR MPEG-2 MULTICHANNEL AUDIO

BACKGROUND OF THE INVENTION

1. Field of the Invention

The present invention relates in general to composite decoding devices for multichannel audio decoders, and more particularly to a composite decoding device for a moving picture experts group-2 (referred to hereinafter as MPEG-2) multichannel audio decoder which is capable of simultaneously processing information coded in a dynamic crosstalk coding manner and information coded in a phantom coding manner.

2. Description of the Prior Art

The MPEG-2 has prescribed the international standards on audio and video signal compression expression methods.

Generally, an audio channel combination includes five channels based on a 3/2 array manner. Namely, the audio channel combination includes three channels of left (referred to hereinafter as L), right (referred to hereinafter as R) and center (referred to hereinafter as C), and two channels of left surround (referred to hereinafter as LS) and right surround (referred to hereinafter as RS).

A dynamic crosstalk coding manner is adapted to use the analogy between channels. The dynamic crosstalk coding manner does not transfer information but only a scale factor with respect to channels with analogous signal waveforms to reduce a bit rate.

A phantom coding manner does not transmit a C channel signal component with respect to signals above the twelfth subband. In this case, the C channel signal component is transmitted while it is divided into L and R channels.

Selective elements required in decoding a signal coded in the dynamic crosstalk coding manner are a dynamic cross LR signal, a transmission channel allocation signal and a dynamic cross mode signal which are specified in ISO/IEC 13818-3. The dynamic crosstalk coding manner is determined according to a combination of the above signals, as shown below in table 1. In addition, table 1 shows a dynamic crosstalk signal combination based on the 3/2 array manner.

TABLE 1

| TRANSMISSION CHANNEL ALLOCATION | T2 | T3 | T4 |
|---|---|---|---|
| 0 | Cw | LSw | RSw |
| 1 | Lw | LSw | RSw |
| 2 | Rw | LSw | RSw |
| 3 | Cw | Lw | RSw |
| 4 | Cw | LSw | Rw |
| 5 | Cw | Lw | Rw |
| 6 | Rw | Lw | RSw |
| 7 | Lw | LSw | Rw |

| DYNAMIC CROSS MODE | TRANSMISSION CHANNEL | | |
|---|---|---|---|
| 0 | T2 | T3 | T4 |
| 1 | T2 | T3 | — |
| 2 | T2 | — | T4 |
| 3 | — | T3 | T4 |
| 4 | T2 | — | — |
| 5 | — | T3 | — |
| 6 | — | — | T4 |
| 7 | — | — | — |
| 8 | T2 | T34 | — |
| 9 | T23 | — | T4 |
| 10 | T24 | T3 | — |
| 11 | T23 | — | — |

TABLE 1-continued

| | | | |
|---|---|---|---|
| 12 | T24 | — | — |
| 13 | — | T34 | — |
| 14 | T234 | — | — |
| 15 | INHIBIT | | |

In table 1, "Tab" signifies that a Ta channel signal is multiplied by scale factors of Ta and Tb channels and then copied to the Ta and Tb channels, respectively. Similarly, "Tabc" signifies that a Ta channel signal is multiplied by scale factors of Ta, Tb and Tc channels and then copied to the Ta, Tb and Tc channels, respectively. Also, "–" signifies that an L channel signal or an LS channel signal is copied to an L0 channel (left channel in stereo) and an R channel signal or an RS channel signal is copied to an R0 channel (right channel in stereo). Further, "–" signifies that a C channel signal is not transmitted. Although not shown in the table 1, the dynamic cross LR signal is a 1-bit signal. In the case where "–" signifies that a C channel signal is not transmitted, the C channel signal is copied to the L0 channel if the dynamic cross LR signal is "0" and to the R0 channel if the dynamic cross LR signal is "1".

Information regarding the phantom coding manner is determined according to a phantom signal. In the case where the phantom signal is "0" indicating that the phantom coding manner is not used, the decoding operation is performed in a similar manner to that in the case of decoding a signal coded in the dynamic crosstalk coding manner. To the contrary, in the case where the phantom signal is "1" indicating that the phantom coding manner is used, a value of "0" is transferred when the C channel is set according to the transmission channel allocation signal regardless of the dynamic cross mode signal.

SUMMARY OF THE INVENTION

It is an object of the present invention to provide a composite decoding device for a multichannel audio decoder which is capable of simultaneously decoding information coded in a dynamic crosstalk coding manner and information coded in a phantom coding manner.

In accordance with the present invention, the above and other objects can be accomplished by a provision of a composite decoding device for a multichannel audio decoder, comprising arithmetic means for receiving a control word, information and a scale factor from a first-in-first-out memory, performing an arithmetic operation with respect to the received information and scale factor on the basis of a dynamic crosstalk coding manner or a phantom coding manner determined by the received control word and outputting the arithmetic result to a dual port memory; and control means for generating a plurality of sequential control signals in response to the control word from the first-in-first-out memory to control the arithmetic means.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
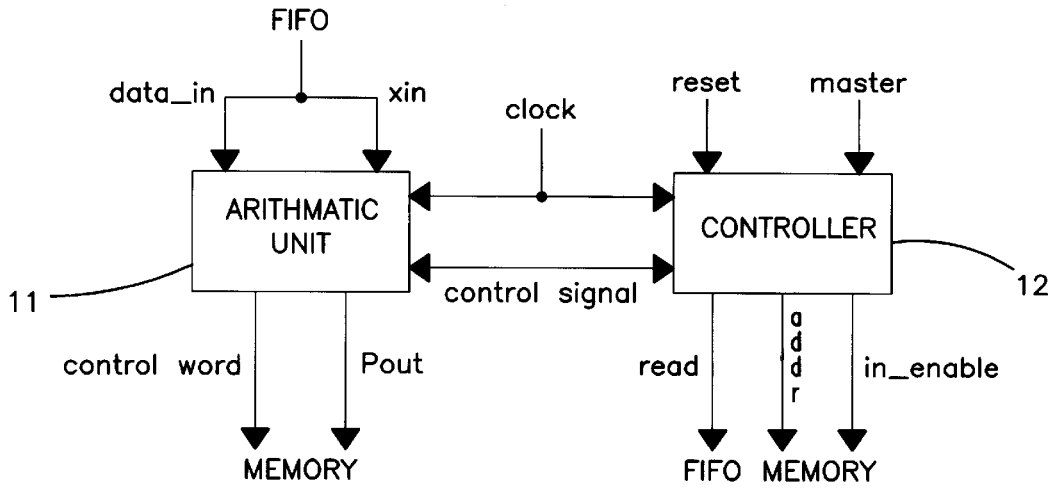
FIG. 1 is a schematic block diagram illustrating the construction of a composite decoding device for a multichannel audio decoder in accordance with an embodiment of the present invention.

FIG. 1 is a schematic block diagram illustrating the construction of a composite decoding device for a multi-channel audio decoder in accordance with an embodiment of the present invention. As shown in this drawing, the composite decoding device comprises an arithmetic unit 11 for receiving a control word, an information and a scale factor from a first-in-first-out (referred to hereinafter as FIFO) memory, performing an arithmetic operation with respect to the received information and scale factor on the basis of a dynamic crosstalk coding manner or a phantom coding manner determined by the received control word and outputting the arithmetic result to a dual port memory. The control word from the FIFO memory contains a phantom signal, a dynamic cross LR signal, a transmission channel allocation signal and a dynamic cross mode signal.

The composite decoding device further comprises a controller 12 for generating a plurality of sequential control signals in response to the control word from the FIFO memory to control the arithmetic unit 11.

Although not shown in FIG. 1, the controller 12 includes first and second logic circuits. The first logic circuit is implemented with a sequential circuit for determining the operation flow of the arithmetic unit 11 in response to the control word from the FIFO memory, and the second logic circuit is implemented with a combination circuit for generating the sequential control signals in response to the output of the first logic circuit.

Figure 2:
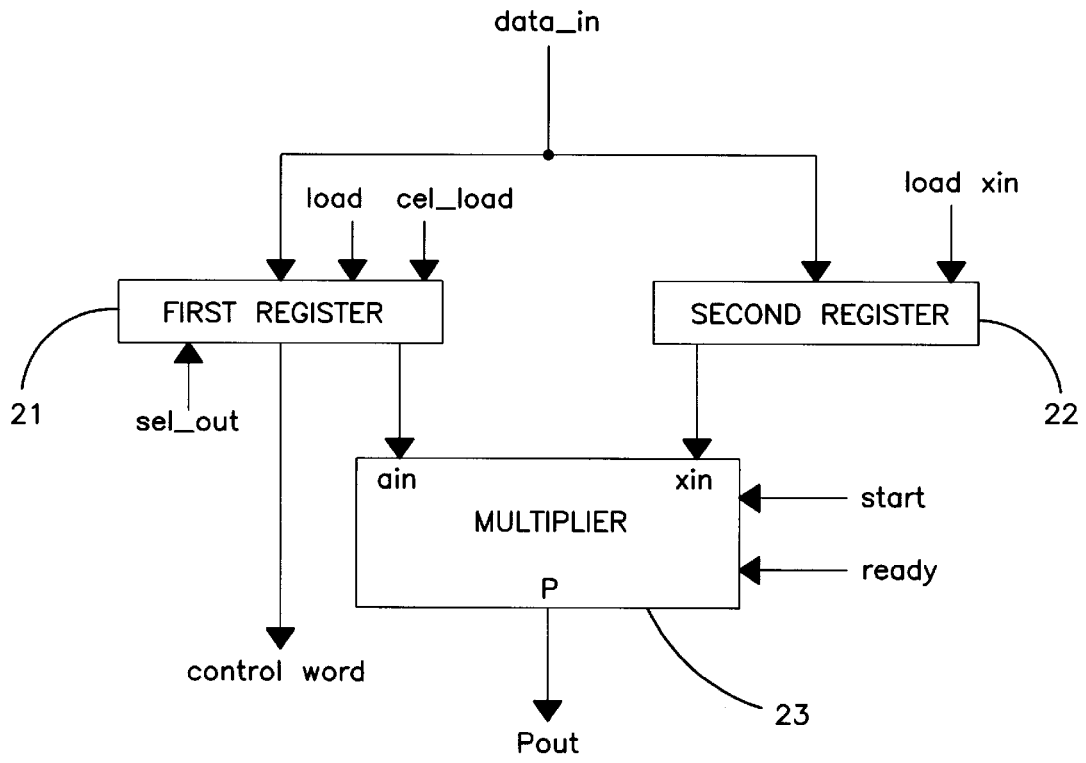
FIG. 2 is a detailed block diagram of an arithmetic unit in FIG. 1.

Referring to FIG. 2, there is shown a detailed block diagram of the arithmetic unit 11 in FIG. 1. As shown in this drawing, the arithmetic unit 11 includes a first register circuit 21 for storing the information from the FIFO memory therein, a second register circuit 22 for storing the scale factor from the FIFO memory therein, and a multiplier 23 for multiplying the information stored in the first register circuit 21 by the scale factor stored in the second register circuit 22 and outputting the multiplied result to the dual port memory.

The first register circuit 21 requires a plurality of registers for storing the information from the FIFO memory therein to implement the algorithm in the above table 1. Namely, the first register circuit 21 includes at least three registers for implementing the algorithm in the above table 1, with the exception of the case where the dynamic cross mode signal is "10". The three registers are an L0 channel information register, an R0 channel information register and a T channel (transmission channel) information register. The L0 channel information register, the R0 channel information register and the T channel information register are loaded with the corresponding information from the FIFO memory and one of output information therefrom is selectively applied to the multiplier 23 to implement the algorithm in table 1.

The L0 channel information register stores L0 channel information from the FIFO memory therein and the R0 channel information register stores R0 channel information from the FIFO memory therein. The T channel information register stores T2, T3 or T4 channel information from the FIFO memory therein. For example, in the case where the transmission channel allocation signal is "0", the dynamic cross mode signal is "13" and the dynamic cross LR signal is "1", the L0 channel information from the FIFO memory is first loaded into the L0 channel information register. The output information from the L0 channel information register is set as the output of the first register circuit 21 and multiplied by the scale factor in the second register circuit 22 by the multiplier 23. The multiplier 23 outputs the multiplied result as an L0 channel value to the dual port memory. Then, the R0 channel information from the FIFO memory is loaded into the R0 channel information register and the subsequent operation is performed in the above-mentioned manner.

As shown in the table 1, the T2 channel value is determined on the basis of the R0 channel information from the FIFO memory. To this end, the output information from the R0 channel information register is set as the output of the first register circuit 21 and multiplied by the scale factor in the second register circuit 22 by the multiplier 23. The T2 channel value is obtained as a result of the multiplication.

Also, the T3 and T4 channel values are determined on the basis of the T3 channel information from the FIFO memory. To this end, the T3 channel information from the FIFO memory is loaded into the T channel information register. Then, the output information from the T channel information register is set as the output of the first register circuit 21 and applied to the multiplier 23. The multiplier 23 multiplies the output of the first register circuit 21 by the scale factors in the second register circuit 22 corresponding to the T3 and T4 channels. The T3 and T4 channel values are obtained as a result of the multiplication.

In order to implement the mode where the dynamic cross mode signal is "10", in the case where the information process is fixed to the order of L0, R0, T2, T3 and T4 channels, there are required two registers for storing the T2 and T3 channel information from the FIFO memory therein, respectively, in addition to the L0 channel information register and the R0 channel information register. As a result, the total four registers must be used to implement the mode where the dynamic cross mode signal is "10". However, in this mode, all information can be processed in the above-mentioned manner by three registers by changing the processing order of T3 and T4 channels.

In addition to the L0 channel information register, the R0 channel information register and the T channel information register, the first register circuit 21 further includes a control register for storing the control word from the FIFO memory therein.

The multiplier 23 is adapted to perform a multiplication operation with respect to the output information from the first register circuit 21 and the scale factor from the second register circuit 22 to implement a composite decoding operation. The output information from the first register circuit 21 is of signed 16 bits (decimal between −1 and 1), and the scale factor from the second register circuit 22 is of unsigned 16 bits (maximum value 2). As a result, the multiplied result from the multiplier 23 is expressed in signed 32 bits and present between −1 and 1. The 32-bit output from the multiplier 23 contains one signed bit, 3 bits above decimal point and the remaining bits below decimal point. The final result is signed 16 bits between −1 and 1. As a result, one bit above decimal point and 15 bits below decimal point of the multiplied result from the multiplier 23 are selected as the final output.

In other words, the multiplier 23 performs the multiplication operation with respect to the signed 16 bits from the first register circuit 21 and the unsigned 16 bits from the second register circuit 22 to provide the output p of signed 32 bits. Then, the 29th to 14th bits of the output p of the multiplier 23 are selected as the final output $P_{out}$.

The controller 12 is adapted to generate control signals to determine the operation of the arithmetic unit 11 every clock. The control signals are classified into basic control signals and combined control signals. The basic control signals are a read signal for the reception of data from the FIFO memory, a load signal for the data storage, a start signal for the multiplication, an address signal for the memory addressing and an input enable signal in_enable for the storage of data in the memory. The combined control signals are produced to implement the algorithm in the above table 1. The combined control signals are a control signal sel_load for the selection of a register to be loaded with data and a control signal sel_out for the determination of output from the first register circuit 21. In order to implement the composite decoding operation, the above control signals are combined according to the control word (phantom signal, dynamic cross LR signal, transmission channel allocation signal and dynamic cross mode signal) from the FIFO memory, the sequential data processing cycles and the corresponding addresses.

As is apparent from the above description, according to the present invention, the composite decoding device for the MPEG-2 multichannel audio decoder has the effect of simultaneously decoding the information coded in the dynamic crosstalk coding manner and the information coded in the phantom coding manner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A composite decoding device for a multichannel audio decoder, comprising:

arithmetic means for receiving a control word, an information and a scale factor from a first-in-first-out memory, performing an arithmetic operation with respect to the received information and scale factor on the basis of a dynamic crosstalk coding manner or a phantom coding manner determined by the received control word and outputting the arithmetic result to a dual port memory; and control means for generating a plurality of sequential control signals in response to the control word from said first-in-first-out memory to control said arithmetic means.

2. A composite decoding device for a multichannel audio decoder, as set forth in claim 1, wherein said arithmetic means includes:

first storage means for storing the information from said first-in-first-out memory therein;

second storage means for storing the scale factor from said first-in-first-out memory therein; and multiplication means for multiplying the information stored in said first storage means by the scale factor stored in said second storage means and outputting the multiplied result to said dual port memory.

3. A composite decoding device for a multichannel audio decoder, as set forth in claim 2, wherein said first storage means includes:

a right audio channel information register for storing right audio channel information from said first-in-first-out memory therein;

a left audio channel information register for storing left audio channel information from said first-in-first-out memory therein; and a transmission channel information register for storing at least one transmission channel information from said first-in-first-out memory therein.

4. A composite decoding device for a multichannel audio decoder, as set forth in claim 3, wherein said first storage means further includes a control register for storing the control word from said first-in-first-out memory therein.

* * * * *